US006077201A

United States Patent [19]

Cheng

[11] Patent Number: 6,077,201

[45] Date of Patent: Jun. 20, 2000

[54] EXERCISE BICYCLE

[76] Inventor: Chau-Yang Cheng, No. 456, Pu Zi Street, Feng Yuan City, Taichung Hsien, Taiwan

[21] Appl. No.: 09/095,928

[22] Filed: Jun. 12, 1998

[51] Int. Cl.[7] ..... A63B 21/00; A61H 1/02

[52] U.S. Cl. ..... 482/57; 482/63; 601/30

[58] Field of Search ..... 482/57, 60, 63, 482/8, 901, 902; 600/502, 513; 601/30, 49, 56, 36

[56] References Cited

U.S. PATENT DOCUMENTS

| | | | |
|---|---|---|---|
| 1,788,176 | 1/1931 | Sturtevant | 601/30 |
| 1,998,522 | 4/1935 | Pyles | 601/30 |
| 2,081,365 | 5/1937 | Mueller et al. | 601/30 |
| 3,713,438 | 1/1973 | Knutsen | 482/63 |
| 4,570,927 | 2/1986 | Petrofsky et al. | 482/63 |

*Primary Examiner*—S. R. Crow
*Attorney, Agent, or Firm*—Browdy and Neimark

[57] ABSTRACT

An exercise bicycle is composed of a bicycle frame, a vibration device, a driving device, and a clutch device. The bicycle frame is provided with a pedal device. The vibration device and the pedal device are driven by the driving device such that the pedal device can be temporarily disabled by the clutch device. The vibration device is capable of actuating the bicycle frame to vibrate so as to massage the body of a user of the exercise bicycle while the user is engaged in the pedalling exercise. The exercise bicycle can be used as a body massaging machine by actuating the clutch device to disable the pedal device.

15 Claims, 4 Drawing Sheets

EXERCISE BICYCLE

FIELD OF THE INVENTION

The present invention relates generally to an exercise device, and more particularly to an exercise bike.

BACKGROUND OF THE INVENTION

The conventional exercise bicycles are generally designed for use by those who are fond of the bicycle. As a result, the conventional exercise bicycles are not suitable for use by those who are not physically fit or are recuperating from illness.

SUMMARY OF THE INVENTION

The primary objective of the present invention is therefore to provide an improved exercise bicycle suitable for use by those who are not in excellent physical condition.

In keeping with the principle of the present invention, the foregoing objective of the present invention is attained by an exercise bicycle consisting of a frame, a seat, a handle, a pedal device, a vibration device, a driving device, and a clutch device. The exercise bicycle is capable of massaging the body of a user thereof by means of the frame which is actuated by the vibration device to swing back and forth. In addition, the pedal device is capable of being actuated by the driving device to provide the legs of the user of the exercise bicycle with the exercising effect. The actuation of the pedal device by the driving device is controlled by the clutch device.

The foregoing objective, features and functions of the present invention will be more readily understood upon a thoughtful deliberation of the following detailed description of a preferred embodiment of the present invention with reference to the accompanying drawings.

DETAILED DESCRIPTION OF THE INVENTION

Figure 1:
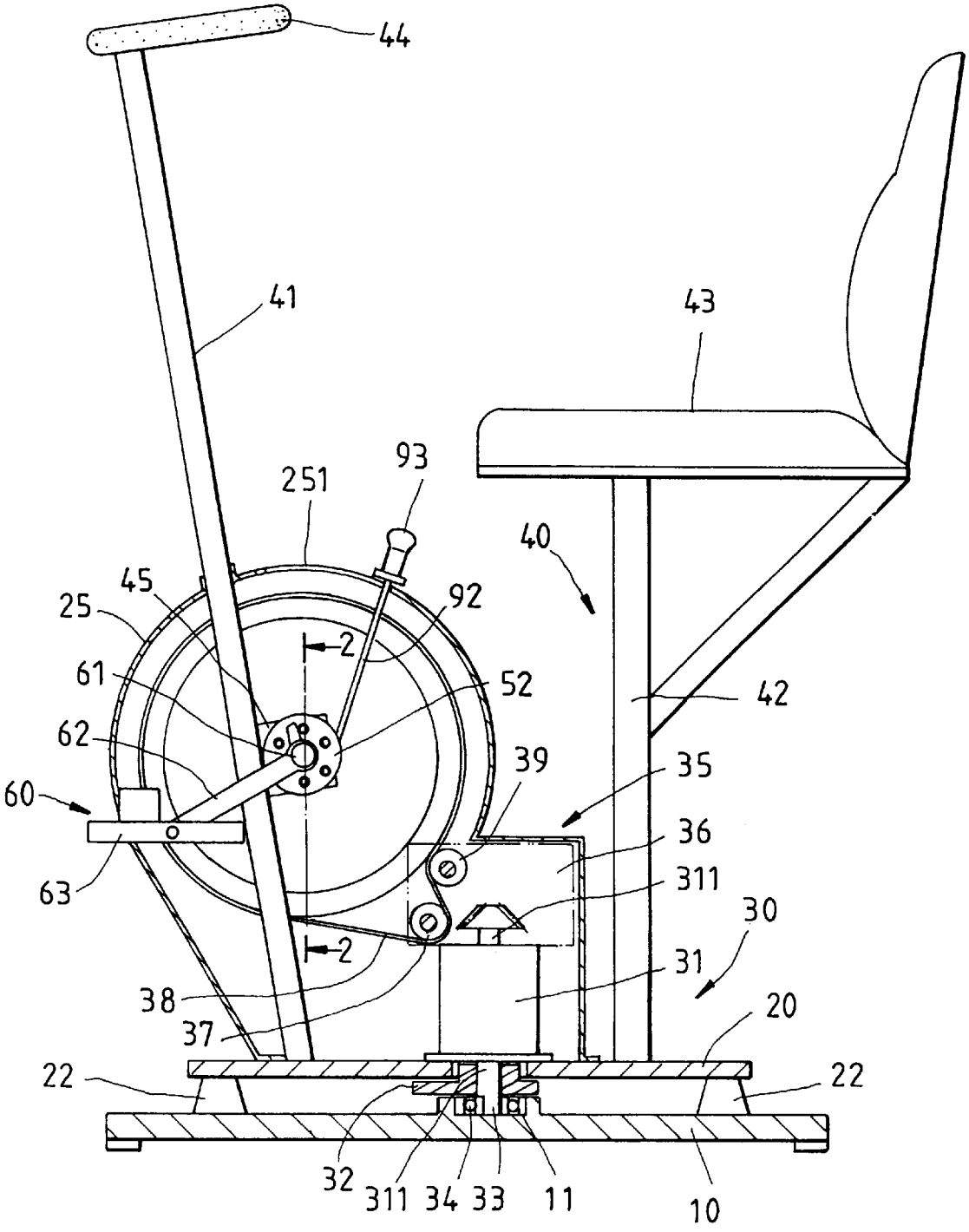
FIG. 1 shows a side schematic view of an exercise bicycle embodied in the present invention.
Figure 2:
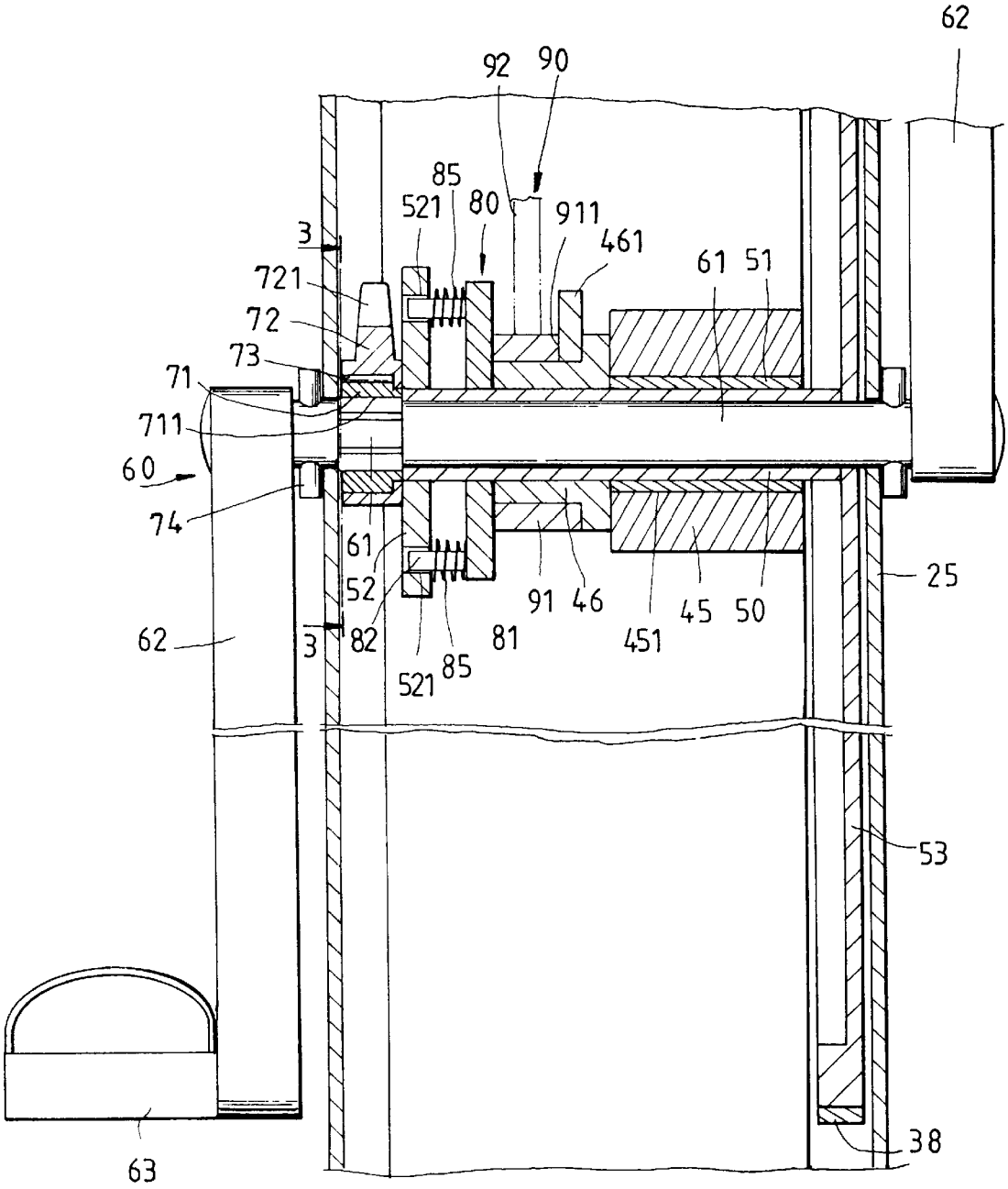
FIG. 2 shows a sectional view of a portion taken along the direction indicated by a line 2—2 as shown in FIG. 1.
Figure 3:
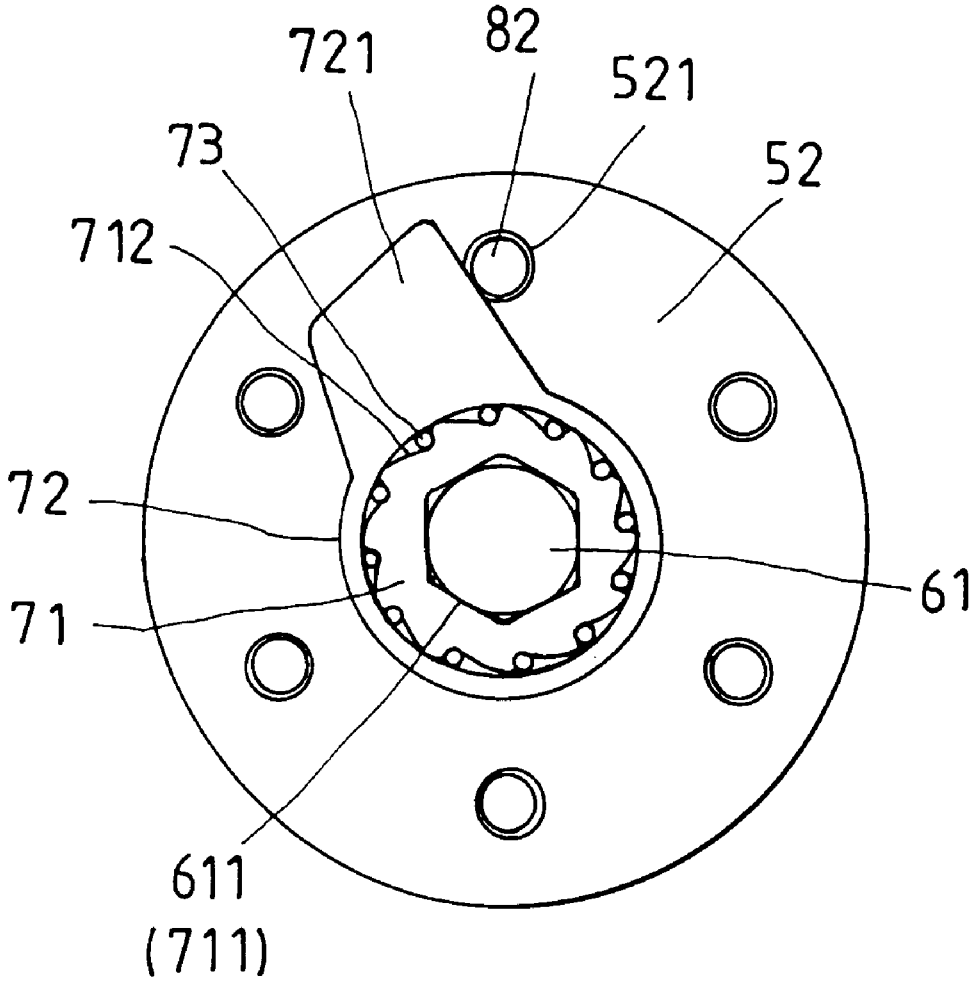
FIG. 3 shows a sectional view of a portion taken along the direction indicated by a line 3—3 as shown in FIG. 2.

As shown in all drawings provided herewith, an exercise bicycle embodied in the present invention is composed of a vibration device 30, a frame 40, a driving device 35, a pedal device 60, and a clutch device.

The vibration device 30 is composed of a base 10 which is rested on a ground or floor, a vibration seat 20, and a motor 31. The vibration seat 20 is platelike in construction and is provided at the top thereof with a shield 25, and along the edges of the underside thereof with a plurality of elastomers 22 of a rubber material. The elastomers 22 have a tapered top and a bottom which is fastened with the upper surface of the base 10. The vibration seat 20 is capable of a horizontal reciprocating motion. The motor 31 is mounted on the vibration seat 20 such that the motor 31 is housed in the shield 25. The motor 31 has a rotary shaft 311 which is extended at the bottom end thereof into the vibration seat 20 and is provided with an inertia fly wheel 32. The bottom end of the rotary shaft 311 is provided with an eccentric columnar body 33 and a bearing 34, which are received in a cavity 11 of the base 10. The vibration seat 20 is capable of being actuated by the motor 31 in motion to bring about a horizontal vibrating motion of a micro-amplitude high frequency.

The frame 40 is composed of a front support 41 and a rear support 42, which are fastened respectively at the bottom thereof with the vibration seat 20. The rear support 42 is provided with a seat 43 fastened therewith, whereas the front support 41 is provided at the top thereof with a handlebar 44. The front support 41 is provided with a seat block 45 which is in turn provided with a pivoting hole 451 and a fastening tube 46 fastened therewith such that the fastening tube 46 is corresponding in location to the pivoting hole 451. The fastening tube 46 is provided in the outer wall thereof with a rodlike guide portion 461 extending outward in the direction of the radius of the fastening tube 46.

The driving device 35 consists of the motor 31 and a tubular body 50. The driving device 35 and the vibration device 30 share the same motor 31. The rotary shaft 311 of the motor 31 is capable of driving a driving wheel 37 via a transmission mechanism 36 (gear). The tubular body 50 and a bearing 51 are engaged pivotally with the pivoting hole 451 of the seat block 45. The tubular body 50 is provided with a link disk 52 fastened therewith such that the link disk 52 is corresponding in location to the fastening tube 46. The link disk 52 is provided with a plurality of through holes 521. The tubular body 50 is further provided at another end thereof with a driven wheel 53 which is link with the driving wheel 37 by a transmission belt 38 which is pressed by an adjustable belt-pressing wheel 39. The tubular body 50 is driven by the motor 31 in motion to rotate in the counterclockwise direction of FIG. 1.

The pedal device 60 has a shaft 61, which is fastened pivotally with the tubular body 50 such that both ends of the shaft 61 are jutted out of the tubular body 50 as well as the shield 25 and are respectively fastened with a crank arm 62. The crank arm 62 is fastened with a pedal 63. The shaft 61 is provided with a hexagonal insertion portion 611 in proximity of the link disk 52. The link disk 52 has a plurality of through holes 521.

The over-running clutch 70 has a ratchet-like first element 71 which is provided with a hexagonal retaining hole 711. The first element 71 is fastened with the shaft 61 such that the hexagonal retaining hole 711 is engaged with the hexagonal insertion portion 611 in conjunction with a locating pin 74. The first element 71 is provided with a tubular second element 72 fitted thereover such that the first element 71 and the second element 72 are provided therebetween with a plurality of tooth gaps 712. Each of the tooth gaps 712 is provided therein with a rolling column 73 enabling the second element 72 to actuate the first element 71 to rotate simultaneously. In addition, the first element 71 is capable of revolving freely in relation to the second element 72. The second element 72 is provided in the outer wall surface thereof with a dial portion 721 extending outward in the direction of the radius of the second element 72.

The clutch device is composed of a turning member 80, a plurality of elastic elements 85, and a control member 90.

The turning member 80 has a disk 81 which is provided with a plurality of rodlike protrusions 82 and is fastened pivotally with the tubular body 50 such that the protrusions 82 are retained in the through holes 521 of the link disk 52. The turning member 80 is thus capable of being actuated by the link disk 52 to rotate along with the tubular body 50.

The elastic elements 85 are coil springs and are fitted over the protrusions 82 of the turning member 80 such that both ends of each of the elastic elements 85 urge the link disk 52 and the disk 81 of the turning member 80. As a result, the turning member 80 is urged to move away from the over-running clutch 70.

The control member 90 has a cylinder 91, which is fastened pivotally with the fastening tube 46 such that one end of the cylinder 91 is in contact with the turning member 80. The cylinder 91 is provided at another end thereof with an inclined side 911 capable of making contact with the guide portion 461 of the fastening tube 46. The cylinder 91 is further provided with a connection rod 92 extending therefrom such that the connection rod 92 is jutted out of the shield 25 via a slot 251 of the shield 25. The connection rod 92 is provided with a handle 93 fastened therewith.

Figure 4:
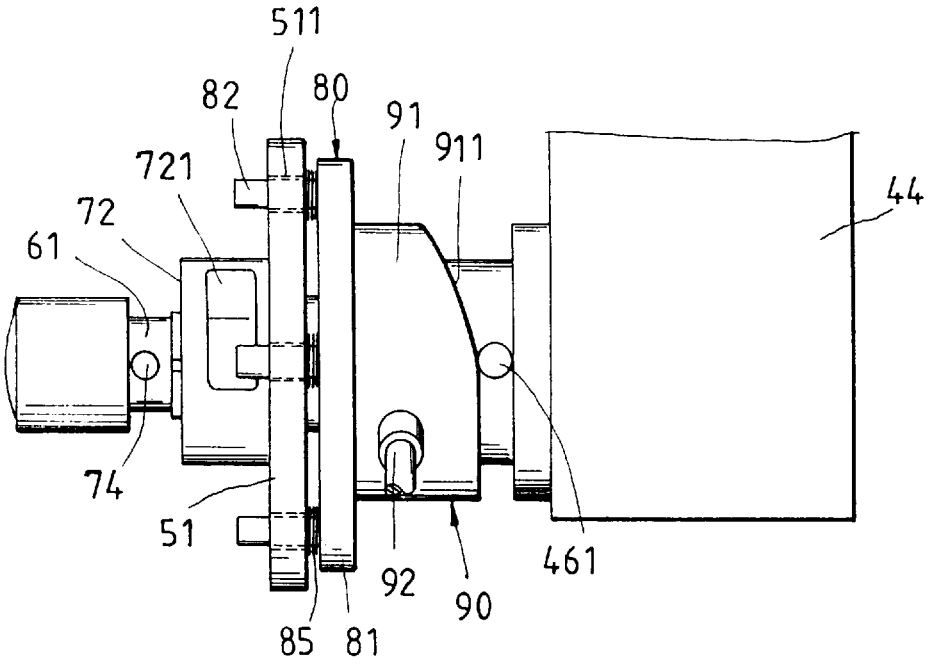
FIGS. 4 and 5 are schematic views of a clutch device of the exercise bicycle of the present invention in motion.
Figure 5:
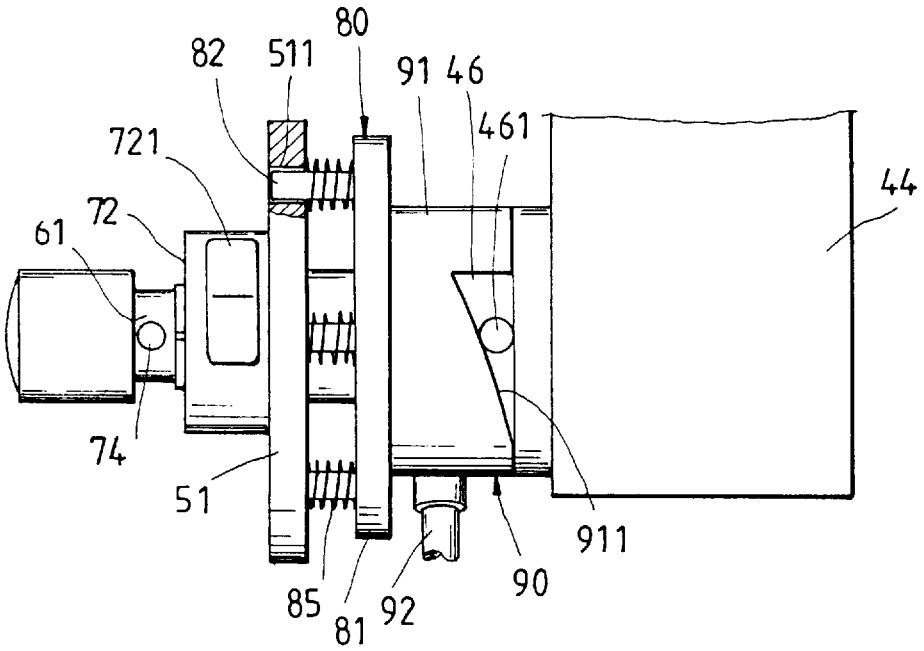

Before using the exercise bike of the present invention, the handle 93 of the control member 90 is first pushed upward to one side farther from the seat 43 such that the cylinder 91 of the control member 90 and the turning member 80 are situated at one side closest to the overrunning clutch 70, and that the ends of the protrusions 82 of the turning member 80 are jutted out of the link disk 52 to press against the dial portion 721 of the second element 72 of the over-running clutch 70, as shown in FIG. 4. The user is seated on the seat 43 before the driving device 35 is started. In the present invention, both the driving device 35 and the vibration device 30 are started simultaneously in view of the fact that they share the motor 31. As soon as the driving device 35 is started, the tubular body 50 is driven by the driving device 35 to turn forward at a slow speed. In the meantime, the turning member 80 is actuated by the tubular body 50 in motion to rotate such that the second element 72 is actuated by the protrusions 82 of the turning member 80 in motion to turn forward. As the second element 72 is actuated to turn forward, the shaft 61 of the pedal device 60 is actuated to turn forward via the first element 71. As a result, both feet of the user of the exercise bike are actuated by the pedal device 60 to engage in the pedalling. In the meantime, the vibration seat 20 is driven by the vibration device 30 to generate the high frequency vibrational motion, which is then imparted via the frame 40 to the seat 43, the handlebar 44 and the pedal device 60 to bring about the massaging effect. In other words, the hips, the back, the hands and the legs of the user seated on the seat 43 are effectively massaged while the user is engaged in the pedalling exercise. However, the pedal device 60 may be intentional disabled while the user is massaged by the exercise bicycle. The pedal device 60 is disabled by pulling the handle 93 backward to one side near the seat 43 such that the cylinder 91 of the control member 90 is urged by the elastic elements 85, and that the inclined side 911 is in contact with the guide portion 461, and further that the protrusions 82 of the turning member 80 are no longer jutted out of the through holes 521 of the link disk 52, thereby resulting in the disengagement of the turning member 80 with the second element 72, as shown in FIG. 5. As a result, the shaft 61 of the pedal device 61 is idled.

The embodiment of the present invention described above is to be deemed in all respects as being merely illustrative and not restrictive. Accordingly, the present invention may be embodied in other specific forms without deviating from the spirit thereof. The present invention is therefore to be limited only by the scopes of the following appended claims.

What is claimed is:

1. An exercise bicycle comprising:

a frame;

a seat mounted on said frame;

a handlebar fastened with said frame;

a pedal device having a shaft fastened pivotally with said frame, said shaft provided at both ends thereof with a crank arm and a pedal fastened pivotally with said crank arm;

a vibration device fastened with said frame such that said vibration device is capable of actuating said frame to vibrate, and that said vibration device is rested on a ground or floor surface;

a driving device fastened with said vibration device such that said driving device is capable of engaging or disengaging said pedal device; and a clutch device mounted between said driving device and said pedal device such that said clutch device is capable of actuating said driving device to engage or disengage said pedal device.

2. The exercise bicycle as defined in claim 1, wherein said vibration device comprises:

a base;

a vibration seat provided in an underside thereof with a plurality of elastomers and mounted on said base such that said elastomers are located between said vibration seat and said base; and a motor provided with a rotary shaft and fastened with said base or said vibration seat such that said rotary shaft is provided at one end thereof with an eccentric columnar body.

3. The exercise bicycle as defined in claim 2, wherein said motor is mounted on said vibration seat; and wherein said elastomers are made of a rubber material and are of a tapered construction.

4. The exercise bicycle as defined in claim 2, wherein said rotary shaft of said motor is provided at one end thereof with an inertia fly wheel fastened therewith.

5. The exercise bicycle as defined in claim 1, wherein said driving device comprises:

a motor;

a driving wheel driven by said motor;

a tubular body fastened pivotally with said frame and provided with a driven wheel fastened therewith such that said driven wheel is linked with said driving wheel by a transmission belt, and that said tubular body is driven by said motor to actuate said shaft of said pedal device via said clutch device.

6. The exercise bicycle as defined in claim 3, wherein said driving device comprises:

said motor of said vibration device;

a driving wheel driven by said motor via a transmission mechanism; and a tubular body fastened pivotally with said frame and provided with a driven wheel fastened therewith such that said driven wheel is linked with said driving wheel by a transmission belt, and that said tubular body is driven by said motor to actuate said shaft of said pedal device via said clutch device.

7. The exercise bicycle as defined in claim 1, wherein said clutch device comprises:

a turning member fastened pivotally with said shaft of said pedal device and driven by said driving device, said turning member provided with at least one protrusion;

at least one elastic element fitted over said protrusion of said turning member such that said elastic element is capable of urging said turning member to move along the direction of a longitudinal axis of said shaft of said pedal device; and a control member fastened pivotally with a fastening tube of a tubular body of said driving device for actuating said turning member to move to engage a dial portion of said shaft of said pedal device such that said turning member can be actuated to move away from said dial portion of said shaft of said pedal device so as to idle said shaft of said pedal device.

8. The exercise bicycle as defined in claim 7, wherein said tubular body of said driving device is fastened pivotally with said frame; wherein said dial portion is located in proximity of said tubular body; and wherein said turning member of said clutch device is fastened pivotally with said tubular body.

9. The exercise bicycle as defined in claim 8, wherein said tubular body is provided at one end thereof with a link disk fastened therewith such that said link disk is corresponding in location to said dial portion, said link disk provided with a plurality of through holes; and wherein said turning member has a disk which is provided with a plurality of protrusions engageable with said through holes of said link disk of said tubular body.

10. The exercise bicycle as defined in claim 9, wherein said protrusions of said turning member are provided respectively with an elastic element fitted thereover such that one end of said elastic element urges said link disk, and that another end of said elastic element urges said disk of said turning member.

11. The exercise bicycle as defined in claim 10, wherein said elastic element is a coil spring.

12. The exercise bicycle as defined in claim 8, wherein said frame is composed of a front support which is provided with a fastening tube having a guide portion; wherein said tubular body is fastened pivotally with said fastening tube of said frame; and wherein said control member of said clutch device has a cylinder which is fastened pivotally with said fastening tube of said frame and is provided with an inclined side capable of making contact with said guide portion of said fastening tube of said frame, said cylinder further provided with a connection rod extending therefrom and having a handle fastened with a free end thereof.

13. The exercise bicycle as defined in claim 7, wherein said shaft of said pedal device is provided with an over-running clutch fastened therewith, said over-running clutch consisting of a first element and a second element such that said first element is fastened with said shaft of said pedal device, and that said first element can be actuated by said second element to rotate relative to said second element; and wherein said dial portion of said shaft of said pedal device is fastened with said second element.

14. The exercise bicycle as defined in claim 13, wherein said shaft of said pedal device is provided with a polygonal insertion portion; and wherein said first element of said over-running clutch is provided with a polygonal retaining hole; wherein said shaft of said pedal device is linked with said over-running clutch such that said polygonal insertion portion is retained in said polygonal retaining hole; and wherein said second element is fitted over said first element such that said second element and said first element are provided therebetween with a plurality of tooth gaps, each of said tooth gaps provided therein with a rolling column enabling said second element to actuate said first element.

15. The exercise bicycle as defined in claim 14, wherein said polygonal insertion portion and said polygonal retaining hole are of a hexagonal construction; and wherein said second element is tubular in shape.

* * * * *